US007275272B2

(12) United States Patent
Gallan

(10) Patent No.: US 7,275,272 B2
(45) Date of Patent: Oct. 2, 2007

(54) SWIMMING POOL LIFT

(76) Inventor: Martin Gallan, P.O. Box 1594, Wilmington, NC (US) 28402

( * ) Notice: Subject to any disclaimer, the term of this patent is extended or adjusted under 35 U.S.C. 154(b) by 303 days.

(21) Appl. No.: 11/197,106

(22) Filed: Aug. 4, 2005

(65) Prior Publication Data

US 2006/0101568 A1 May 18, 2006

Related U.S. Application Data

(60) Provisional application No. 60/598,616, filed on Aug. 4, 2004.

(51) Int. Cl.
*A47K 3/12* (2006.01)

(52) U.S. Cl. ..... 4/496; 4/563.1

(58) Field of Classification Search ..... 4/496, 4/560.1–566.1; 414/921
See application file for complete search history.

(56) References Cited

U.S. PATENT DOCUMENTS 3,815,163 A * 6/1974 Sullivan ..... 4/562.1
4,075,719 A * 2/1978 Sullivan ..... 5/87.1
4,183,106 A 1/1980 Grimes et al.
4,221,008 A 9/1980 Nolan
4,283,803 A 8/1981 Krumbeck
4,941,216 A * 7/1990 Boublil ..... 4/496
4,996,725 A 3/1991 Nolan
5,218,727 A 6/1993 Krumbeck
5,367,721 A 11/1994 Boyles
5,383,238 A 1/1995 Morris
5,432,961 A 7/1995 Horton
5,465,433 A 11/1995 Nolan
5,572,921 A 11/1996 Krumbeck
5,836,020 A 11/1998 Morris
5,960,488 A 10/1999 Morris
6,226,809 B1 * 5/2001 Davies ..... 4/563.1
6,378,659 B1 4/2002 Krumbeck

* cited by examiner

*Primary Examiner*—Huyen Le
(74) *Attorney, Agent, or Firm*—MacCord Mason PLLC

(57) ABSTRACT

A portable apparatus for use in lowering and lifting a user into and out of a swimming pool includes a frame with vertical, longitudinally adjustable legs, horizontal support arms extending rearwardly from the upper ends of the legs, and feet extending forward from the lower ends of the legs. The support arms are adapted to rest on the pool deck and the feet are adapted to rest on the pool bottom, with the apparatus being held on position only by the frictional forces of the arms and the feet. The apparatus further includes a hydraulic cylinder moveable between raised and lowered positions, and a chair moved into the pool when the cylinder is moved toward its lowered position and lifted above the pool when the cylinder is in its raised position. The chair can be rotated at least 180° when in the raised position to permit user ingress and egress.

20 Claims, 2 Drawing Sheets

SWIMMING POOL LIFT

This application claims the benefit of the filing date of Provisional Application Ser. No. 60/598,616, filed Aug. 4, 2004.

BACKGROUND OF THE INVENTION

1. Field of the Invention

The present invention relates to an apparatus for lifting and lowering a handicapped person into and out of a pool of water. The invention is particularly well suited for portable operation with an in-ground swimming pool such as those found at hotel locations.

2. Description of the Prior Art

The Americans with Disabilities Act (ADA) prohibits discrimination on the basis of disability. As a result, ADA guidelines specify that a swimming pool must either have a sloped entry or a lift to provide disabled persons access into the pool's water. The prior art has favored lifts as a means of handicapped access for swimming pools in which a sloped entry would not be practical. These prior art type lifts are usually permanently anchored to a deck or sidewall of the pool. Permanent attachment of a lift to a pool deck or sidewall has disadvantages in that a permanently attached lift is constantly exposed to the harsh chemicals and otherwise corrosive environment that is associated with swimming pools. Therefore, at facilities where handicapped access is used infrequently, permanent attachment of a lift to a pool sidewall or deck is less than an optimal solution. What is needed is a swimming pool lift that can be conveniently used, yet be able to avoid long-term exposure to a corrosive swimming pool environment.

SUMMARY OF THE INVENTION

The present invention is a portable lift for lowering and raising a person into and out of a swimming or therapeutic pool having a bottom, a deck and sidewalls. As used herein, the term "pool" encompasses swimming pools, therapeutic pools or baths, and other constructed enclosures of water designed for immersion of the human body. A "deck" as used herein refers to the horizontal surface area extending outwardly from the pool sidewalls.

The lift is generally comprised of a chair attached directly or indirectly to a moveable hydraulic cylinder that is slidably attached to a piston that is directly or indirectly attached to a frame. The chair for carrying a person has a seat and preferably a seat back. The chair is attached upright to the hydraulic cylinder. Optionally, the seat can be equipped with side rails and a seatbelt for additional safety. The frame has two lockable adjustable legs connected by at least one cross brace. Each of the legs has an upper section including an outwardly extending horizontal arm having a lower surface to press downwardly against the pool deck surface to hold the frame upright against one of the pool sidewalls, and a lower section that includes an inwardly extending foot having a lower surface to press downwardly on the pool bottom to support the combined weight of the lift and a person carried by the lift. The upper and lower leg sections are translationally attached lengthwise such that the overall length of each leg can be longitudinally adjusted to accommodate different pool depths.

It is preferred that the piston is an elongated round rod having a given diameter, a vertical axis and upper and lower ends. It is also preferred that the lower end of the piston be permanently attached to the at least one cross brace such that its length runs substantially parallel to the length of the frame legs. The hydraulic cylinder is adapted to move in vertical alignment up and down on the piston between a fully lowered position and a fully raised position. Moreover, it is preferred that the cylinder is rotatable at least 180° around the vertical axis of the piston whenever the cylinder is in the fully raised position to align the chair over the pool deck. The hydraulic cylinder has a fluid chamber with a fluid intake port and a fluid discharge port.

While hydraulic fluids known in the prior art could power the cylinder and piston of the present invention, pool water provides the most convenient hydraulic fluid. In this case, a battery powered D.C. motor is the prime mover for a water pump that has an inlet and an outlet. An electric battery is wired to the D.C. motor through a user operated on/off switch that is located within easy reach of the lift's chair.

An inlet hose has a suction end and a pump inlet end. During operation, the hose suction end is submerged in the pool water and the pump inlet end is connected to the pump inlet. An outlet hose is connected between the pump outlet and the cylinder intake. A user operated discharge valve having opened and closed positions is in communication with the cylinder discharge port.

While additional attachment means can be used, the lift is designed to be portable in that no bolts or other attachment means are used to secure the lift to any part of the pool. Instead, the lift is designed to be held in place against a pool sidewall solely by the frictional forces between the frame arms pressing against the pool deck and by the frame feet pressing against the pool bottom. As a result, the lift can be easily moved to a new location or placed in storage when not in use.

Before the lift can be used it must be properly placed at a desirable pool entry location. The lift placement process begins with maneuvering the legs of the lift over a sidewall of the pool at the desired pool entry location. The frame is then pushed or pulled against the pool sidewall such that the frame arms extend completely onto the pool deck. Each lower leg section is then translated downward until each leg foot firmly rests on the bottom of the pool. The lower leg sections are then locked to their respective upper leg section so that legs can support their full rated load. Lastly, the inlet hose suction end is submerged in the pool water and the battery is connected through the operator switch to the D.C. motor.

In operation, a user closes the discharge valve and turns the switch on allowing electrical current to flow from the battery to the motor powering the pump. While the motor is energized the pump transfers water from the pool through the inlet and outlet hoses and into the fluid chamber of the hydraulic cylinder. The water entering the fluid chamber exerts forces against the chamber and the piston, thereby raising the cylinder along the axis of the piston. The rising cylinder lifts the chair out of the pool to a level slightly above the deck of the pool as the cylinder reaches its raised position. Once the cylinder is in the fully raised position, the user or a helper can rotate the cylinder to align the chair over the pool deck so that the user can get into the chair and can secure himself into the chair with the seatbelt. Once the user is secured to the chair, the user or helper can rotate the cylinder in a direction that places the chair completely over the pool water. The user then can lower himself into the pool water by opening the cylinder discharge valve, releasing the water accumulated in the fluid chamber. Once the user is satisfactorily in the water the discharge valve can be closed, and the user may disembark the chair.

Whenever the user is ready to get out of the pool, he can maneuver himself into the lift chair and secure himself to the chair with the seatbelt. Next, the user will manually actuate the lift control handle to close the discharge valve and turn on the switch to energize the pump motor to pump water into the hydraulic cylinder, thus raising the cylinder and chair. Once the cylinder has reached its raised position, the pump motor is switched off. The closed discharge valve maintains the water pressure inside the cylinder, thereby holding the cylinder in its raised position.

At this point the cylinder can be rotated such that the chair is safely over the deck of the pool. Once safely over the deck of the pool the user can release himself from the seatbelt and the chair. Since the lift is not permanently attached to the pool deck or sidewalls, one or more able-bodied persons can remove the lift from the pool and store it away from the corrosive environment of the pool until it is needed again.

BRIEF DESCRIPTION OF THE DRAWINGS

In the following drawings like reference characters in the same or different figures indicate like parts.

Figure 1:
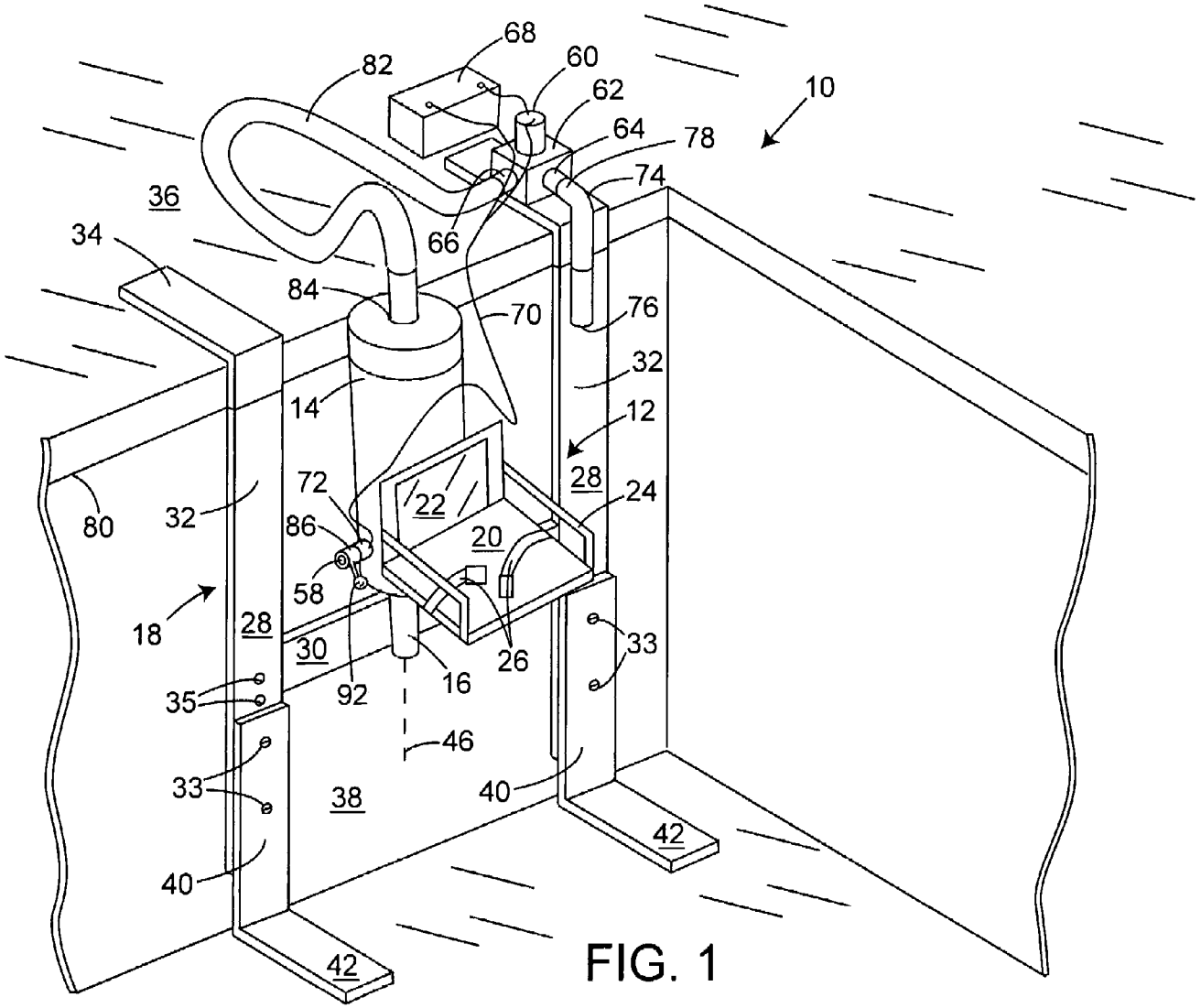
FIG. 1 is a perspective view of the swimming pool lift in the lowered position.

As can be seen from the drawings and starting with FIG. 1, a lift 10 is comprised of a chair 12 attached to a moveable hydraulic cylinder 14 that is slidably attached to a piston 16 attached to a frame 18. Chair 12 has a seat 20 with a back 22 attached to hydraulic cylinder 16. Optionally, seat 20 can be equipped with side rails 24 and a seatbelt 26 for additional safety. Frame 18 has two lockably adjustable legs 28 connected by at least one cross brace 30. Each of legs 28 has an upper section 32 including an arm 34 for resting against a pool deck 36 for holding legs 28 upright against a pool sidewall 38, and a lower leg section 40 including a foot 42 for resting on a pool bottom 44 to support the combined weight of lift 10 and a person carried by lift 10. The upper and lower leg sections 32 and 40 are translationally attachable lengthwise such that the overall length of each leg 28 can be adjusted to accommodate different pool depths. Leg sections 32 and 40 are preferably locked together using threaded fasteners 33 that mate with threaded bores 35.

Figure 2:
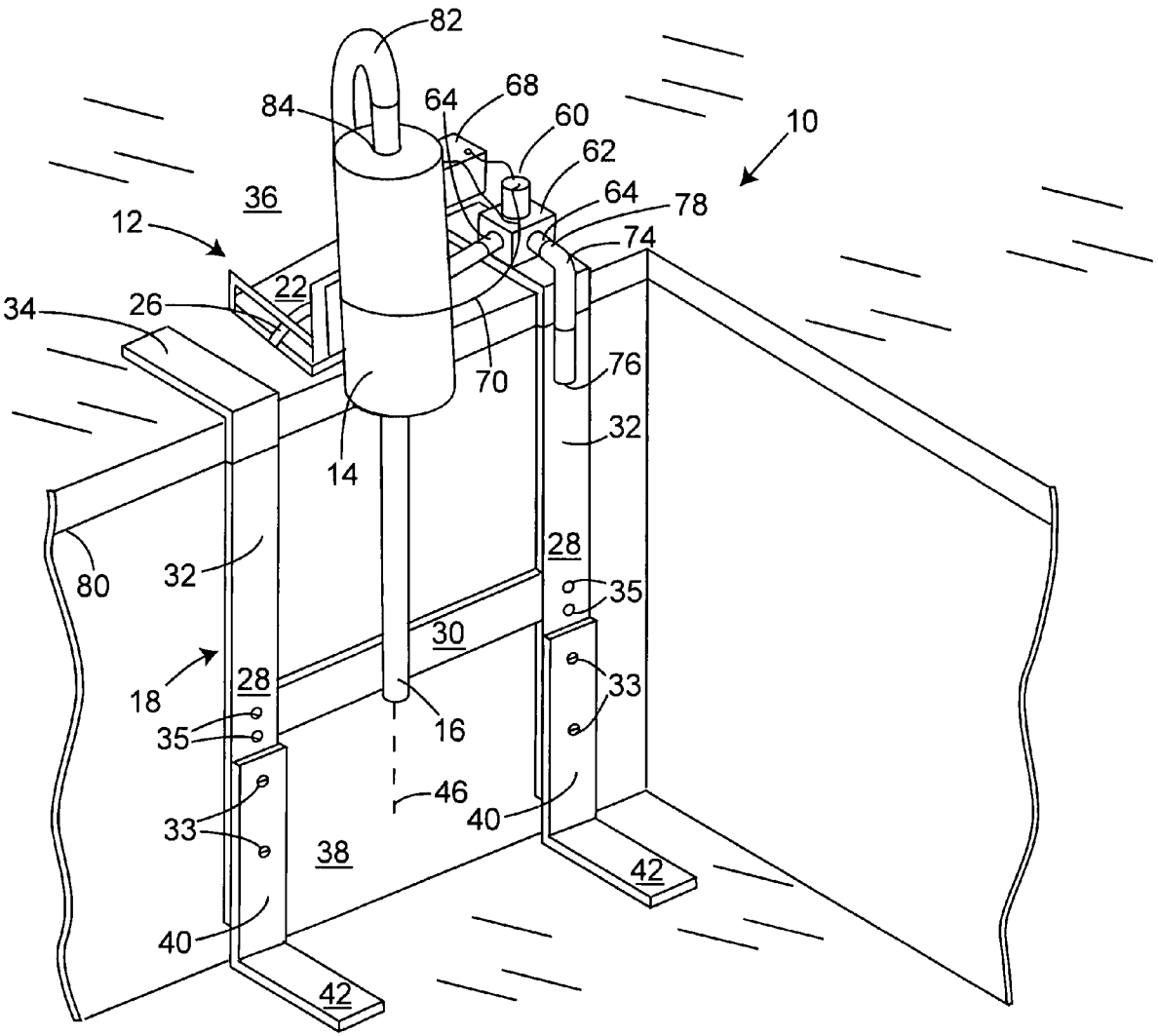
FIG. 2 is a perspective view of the swimming pool lift in the raised position.

It is preferred that piston 16 is an elongated round rod having a given diameter, a vertical axis 46 and a lower end 50. It is also preferred that piston 16 be permanently attached to cross brace 30 such that its length runs substantially parallel to the length of frame legs 28. Hydraulic cylinder 14 is adapted to move in vertical alignment up and down on the piston 16 between a lowered position as shown in FIG. 1 and a raised position as shown in FIG. 2. Moreover, as shown in FIG. 2, it is preferred that cylinder 14 be able to rotate at least 180° around vertical axis 46 whenever cylinder 14 is in a raised position. Hydraulic cylinder 14 has a fluid chamber with a fluid intake port 56 and a fluid discharge port 58.

While hydraulic fluids known in the prior art could power cylinder 14 and piston 16 of the present invention, pool water provides the most convenient hydraulic fluid. In this case, a battery-powered motor 60 is the prime mover for a water pump 62 that has an inlet 64 and an outlet 66. An electrical battery 68 is electrically connected to motor 60 through electrical wires 70 and a user operated on/off switch 72 that is located within easy reach of chair 12.

An inlet hose 74 has a suction end 76 and a pump inlet end 78. During operation, hose suction end 76 is submerged below pool water line 80 and inlet end 78 is connected to pump inlet 64. An outlet hose 82 is connected between pump outlet 66 and a cylinder intake 84. A user operated discharge valve 86 having an opened position and a closed position is in communication with cylinder discharge port 58. A lift control handle 92 is used to manually operate both discharge valve 86 and switch 72. Whenever lift control handle 92 is actuated forward as shown in FIG. 1, switch 72 is turned off and discharge valve 86 is opened, allowing water to slowly discharge from hydraulic cylinder, thereby dropping chair 12 slowly and safely into the pool water. Whenever lift control handle 92 is actuated in a reverse direction, discharge valve 86 is closed and switch 72 is turned on, energizing motor 60, which in turn powers pump 62, pumping pool water into cylinder 14. Since discharge valve 86 is closed while water enters cylinder 14, pressure builds within cylinder 14. This pressure within cylinder 14 presses against piston 16, thereby raising cylinder 14 and chair 12 vertically out of the pool water. Once chair 12 is sufficiently out of the water, lift control handle 92 can be actuated to a neutral position, turning off switch 72 while still keeping discharge valve 86 closed. This action stops the upward movement of cylinder 14 and chair 12, while maintaining the accumulated hydraulic pressure to hold the chair and cylinder in the raised position shown in FIG. 2.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An apparatus for lowering and lifting a user into and out of a pool having a deck, a sidewall and a bottom comprising:

a) a frame having vertical, longitudinally adjustable legs with upper and lower ends, horizontal deck support arms extending rearwardly from the upper ends of said legs, and feet extending forward from the lower ends of said legs, said deck support arms being adapted to rest on said deck and said feet being adapted to rest on said bottom when said apparatus is mounted in said pool;

b) a hydraulic cylinder moveable on said frame between a fully raised position and a fully lowered position; and c) a chair attached to said cylinder, whereby said seat is moved into said pool when said cylinder is moved toward its lowered position and is lifted above said pool when said cylinder is in its fully raised position.

2. The apparatus is claim 1, wherein said apparatus is adapted to be held to said pool only by the frictional forces of said deck support arms and said feet.

3. The apparatus of claim 1, wherein said hydraulic cylinder is carried on a piston mounted on said frame.

4. The apparatus of claim 1, wherein said hydraulic cylinder is rotatable when said cylinder is in its fully raised position.

5. The apparatus of claim 1, wherein said hydraulic cylinder uses water as a hydraulic fluid.

6. The apparatus of claim 1, wherein said hydraulic cylinder is powered by a pump having an inlet hose with a suction end immersible in said pool during use, whereby water is drawn from said pool into said hydraulic cylinder to move said cylinder toward its raised position.

7. The apparatus of claim 1, further including control means accessible by a user when seated in said chair.

8. An apparatus for lowering and lifting a user into and out of a pool having a deck, a sidewall and a bottom comprising:

a) a frame having vertical, longitudinally adjustable legs with upper and lower ends, horizontal deck support arms extending rearwardly from the upper ends of said legs, and feet extending forward from the lower ends of said legs, said deck support arms being adapted to rest on said deck and said feet being adapted to rest on said bottom when said apparatus is positioned for use in said pool, whereby said apparatus is held to said pool only by the frictional forces of said deck support arms and said feet;

b) a hydraulic cylinder moveable on said frame between a fully raised position and a fully lowered position; and c) a chair attached to said cylinder, whereby said seat is moved into said pool when said cylinder is moved toward its lowered position and is lifted above said pool when said cylinder is in its fully raised position.

9. The apparatus of claim 8, wherein said hydraulic cylinder uses water as a hydraulic fluid.

10. The apparatus of claim 8, further including a vertical piston mounted on said frame, said hydraulic cylinder being carried on said piston.

11. The apparatus of claim 8, wherein said chair is rotatable away from said pool and over said deck when said cylinder is in its fully raised position.

12. The apparatus of claim 8, wherein said hydraulic cylinder uses water as the hydraulic fluid and is powered by a pump having an inlet hose with a suction end immersible in said pool during use, whereby water is drawn from said pool into said hydraulic cylinder to move said cylinder toward its raised position.

13. The apparatus of claim 8, wherein said apparatus includes two longitudinally adjustable, lockable legs joined by a cross-brace.

14. The apparatus of claim 8, wherein chair includes a seat and a seat back.

15. A portable apparatus for lowering and lifting a user into and out of a swimming pool having a deck, a sidewall and a bottom comprising:

a) a frame having vertical, longitudinally adjustable legs with upper and lower ends, horizontal deck support arms extending rearwardly from the upper ends of said legs, and feet extending forward from the lower ends of said legs, said deck support arms being adapted to rest on said deck and said feet being adapted to rest on said bottom when said apparatus is mounted in said pool, whereby said apparatus is held against said pool sidewall only by the frictional forces of said deck support arms and said feet;

b) a vertical piston mounted on said frame;

c) a hydraulic cylinder that uses water as the hydraulic fluid slidable on said piston between a fully raised position and a fully lowered position; and d) a chair attached to said cylinder, whereby said chair is moved into said pool when said cylinder is moved toward its lowered position and is lifted above said pool when said cylinder is in its fully raised position.

16. The apparatus of claim 15, wherein said cylinder is rotatable at least 180° on said piston to position said chair over said deck when said cylinder is in its fully raised position.

17. The apparatus of claim 15, wherein said chair includes a seat belt.

18. The apparatus of claim 15, wherein said hydraulic cylinder is powered by a pump having an inlet hose with a suction end immersible in said pool during use, whereby water is drawn from said pool into said hydraulic cylinder to move said cylinder toward its raised position.

19. The apparatus of claim 15, wherein said pump includes a discharge valve and is powered by a battery-powered motor having an on-off switch, said discharge valve and said switch being controllable by a control means accessible by a user seated in said chair.

20. The apparatus of claim 15, wherein said apparatus includes two longitudinally adjustable, lockable legs joined by a cross-brace, said piston being attached to said cross-brace.

* * * * *